US007173883B2

(12) United States Patent
Seyr

(10) Patent No.: US 7,173,883 B2
(45) Date of Patent: Feb. 6, 2007

(54) ANALOGUE CHRONOGRAPH COMPRISING A DIGITAL DISPLAY

(75) Inventor: Ernst Seyr, Bettlach (CH)

(73) Assignee: Eterna AG Uhrenfabrik, Grenchen (CH)

( * ) Notice: Subject to any disclaimer, the term of this patent is extended or adjusted under 35 U.S.C. 154(b) by 43 days.

(21) Appl. No.: 10/477,499

(22) PCT Filed: May 14, 2002

(86) PCT No.: PCT/CH02/00261

§ 371 (c)(1),
(2), (4) Date: Nov. 12, 2003

(87) PCT Pub. No.: WO02/093273

PCT Pub. Date: Nov. 21, 2002

(65) Prior Publication Data

US 2004/0170088 A1 Sep. 2, 2004

(30) Foreign Application Priority Data

May 14, 2001 (CH) ..... 878/01

(51) Int. Cl.
*G04F 8/00* (2006.01)
*G04F 10/00* (2006.01)

(52) U.S. Cl. ..... 368/110; 368/223

(58) Field of Classification Search ..... 368/110, 368/107, 106, 223, 77, 89, 108, 226
See application file for complete search history.

(56) References Cited

U.S. PATENT DOCUMENTS

| | | | | |
|---|---|---|---|---|
| 2,633,696 | A * | 4/1953 | Youhouse | 368/221 |
| 3,675,413 | A * | 7/1972 | Fluck | 368/106 |
| 3,934,405 | A * | 1/1976 | Baker | 368/233 |
| 4,037,398 | A | 7/1977 | Flumm et al. | |
| 4,106,282 | A * | 8/1978 | Larsson | 368/106 |
| 5,623,456 | A * | 4/1997 | Miyamoto et al. | 368/226 |
| 6,761,478 | B2 * | 7/2004 | Schmiedchen et al. | 368/101 |

FOREIGN PATENT DOCUMENTS

| | | |
|---|---|---|
| CH | 119761 A | 4/1927 |
| EP | 0389732 A | 3/1990 |

* cited by examiner

*Primary Examiner*—Judy Nguyen
*Assistant Examiner*—Leo T. Hinze
(74) *Attorney, Agent, or Firm*—The Webb Law Firm

(57) ABSTRACT

Disclosed is an analogue chronograph comprising a digital display. The digital display contains an hour and/or minute indicator using numbers. The latter are arranged on individual circular tracks and under a viewing window, form the hour and/or minute indicator in a digital manner. The minute indicator, in particular, can be sub-divided into decimal and unit positions. The chronograph enables the elapsed time to be easily read, even when subjected to strong vibrations, or when the wearer of the chronograph can only glance at the face. The hour indicator has, in addition to numbers 0 to e.g. 9, a symbol similar to a flag, in order to indicate that the limit of the validity range of the time measurement has been reached.

11 Claims, 1 Drawing Sheet

ANALOGUE CHRONOGRAPH COMPRISING A DIGITAL DISPLAY

CROSS REFERENCE TO RELATED APPLICATIONS

This application is a 371 of Application No. PCT/CH02/00261, filed May 14, 2002, which claims priority from Swiss Patent Application No. 0878/01, filed May 14, 2001.

BACKGROUND OF THE INVENTION

1. Field of the Invention

Both analogue and digital chronographs are known from the prior art. This invention relates to an analogue chronograph comprising a digital display.

2. Description of the Related Art

In the case of known analogue timepieces and chronographs, the date indicator, for example, is digital. It is additionally known here to separate the 10s digits of the date and the units digits.

In the case of chronographs, the seconds part of the time at which the relevant chronograph is to be stopped is usually indicated by a centrally rotating second hand. Minute indicators and any hour indicators present are constituted by small dials.

CH 119 761 presents a timepiece in the case of which the hour is displayed digitally in a window which moves along with a movable disk which displays the minutes in extension of the window.

EP 389 732 discloses a further timepiece, in the case of which a disk with numerals is provided, with the result that a corresponding display is visible in a window. In this case, the magnitude of the disk provided with numerals is coordinated with the magnitude of the rotating disk, with the result that the numbers may be selected to be as large as possible.

Chronographs of the prior art have hand indicators. The disadvantage with known chronographs with hand indicators is that minutes and hours are difficult to read. This applies, in particular, to the latter being read during an activity in which the person wearing the timepiece cannot spend a few seconds concentrating on the timepiece in order to read the dial strokes precisely. This applies, for example, to vehicle drivers and pilots. The timepieces which are preferred by pilots in particular are thus usually configured with a relatively large dial, in order for it to be possible to increase the distance between dial strokes and to enhance the reading capability.

SUMMARY OF THE INVENTION

Taking this prior art as the departure point, the object of the invention is to configure a chronograph of the type mentioned in the introduction such that the time at which the chronograph is stopped is easy to read.

This object is achieved according to the invention, in the case of a chronograph of the type mentioned in the introduction, in that the digital display displays hours and/or minutes by numbers which are arranged on individual circular tracks and, under a viewing window, configure the hour indicator and/or the minute indicator in digital form.

The advantage for the users, in the case of such a digital display of the minutes, is that he/she can read the minutes or hours directly in digital form without using a dial-stroke indicator. This allows a time which has been registered by the chronograph to be read reliably even in the case of vibrations and makes it possible to cast just a quick glance at the dial.

In the case of a preferred embodiment, the tens digits of the minutes are separated from the units digits. In particular, it is possible, using a restoring function, to move the indicator for the hours, tens of minutes and minutes back to the starting position, the display of the number zero.

In the case of a preferred use form, it is possible for the display also to be configured as a tachymeter. In this case, the display is configured as a speed indicator which, by way of inverse gearwheel transmission, counts down from a maximum settable speed. As an alternative to this, it is possible to provide a mechanism which in a manner similar to a flyback chronograph, only takes effect when the stopping function is triggered, i.e. the time is stopped. A wheel train is set in motion at this point in time, said wheel train remaining at the stop second at the point at which the time is stopped. The indicator disks, rather than being moved during the actual stopping operation, are thus made to follow on. The energy for this follow-on movement, similar to the repetition, may be obtained from an additional energy source which is charged up by a switchover mechanism or the like such as a button.

For displaying the digital numerals in the dark, it is possible to coat the surround of the display window with a predetermined quantity of fluorescent material, which supplies sufficient light to allow the numerals, which are made of an essentially highly reflective material and are arranged on the indicator disks, to light up indirectly against the background of the disks.

BRIEF DESCRIPTION OF THE DRAWINGS

The invention will now be explained in more detail with reference to exemplary embodiments. In the figures.

DETAILED DESCRIPTION OF THE INVENTION

Figure 1:
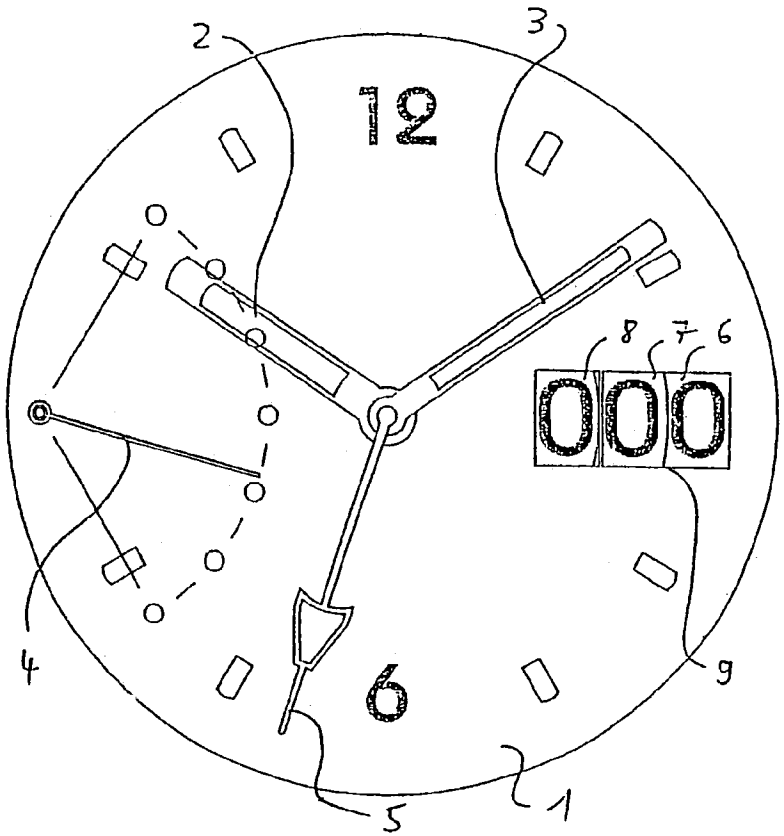
FIG. 1 shows a schematic illustration of a dial of a first exemplary embodiment of a chronograph according to the invention.

FIG. 1 shows, schematically, the dial of a chronograph of a first exemplary embodiment according to the invention. The hands of the hour and minute indicators of the timepiece are designated 2 and 3. The second hand of the timepiece is arranged laterally as a retrogressive second hand 4 and pivots over a range of 120°. It is possible here for this range to correspond to a period of time of 20 seconds, so that the resulting angular speed is identical to the angular speed of a rotating second hand. The second hand 5 of the chronograph is arranged coaxially in relation to the hour and minute hands 2, 3 of the timepiece. The disks 6, 7 and 8 indicating the minutes, tens of minutes, and hours of the chronograph are likewise provided coaxially in relation to said hands. The minute indicator on the disk may be arranged, for example, in two sequences of 0 to 9. The indicator for the tens of minutes may bear two sets of the numbers 0 to 5 or also the numbers 0 to 6 or 0 to 9 for a tachymeter display. The hour indicator goes, for example, from 0 to 9 and bears a further symbol between 9 and 0. This is, in particular, a symbol which is commonly used in aviation for indicating that something is "out of order", e.g. a correspondingly designed flag. Once a time measurement of 10 hours has been reached, a flag or some other symbol, on the far side of the 9, thus indicates that the displayable time range has been exceeded, and consequently demonstrates the invalidity of the display. It is thus indicated to the user that the chronograph has been running for longer than 10 hours without interruption and is no longer able to provide a clear indication of the amount of time elapsed. Instead of the numbers 0 to 9, it is also possible for the hour indicator 8 to bear the numbers 0 to X, and provided between X and 0 is the aforementioned symbol which, once X hours 59 minutes and 59 seconds have elapsed, then appears permanently as an hour indicator 8, in order to indicate that the regular measuring range has elapsed. It is possible, in particular, for X to be greater than the single-digit number nine.

The display can be seen through the windows 9 in the immobile dial 1. The windows 9 for hours and minutes may be continuous or, as in the figures, separated by a crosspiece. The numbers 6, 7, 8 may be of the same size, or the hour indicator 8, in particular, may be selected to be somewhat smaller than the minute numbers 6 or 7.

In the case of a preferred use form, the chronograph is also configured as a tachymeter. In this case, the display is activated as a speed indicator which, by way of an inverse gearwheel transmission, counts down from a maximum settable speed. In the case of such a function as a speed indicator, it is possible, for example in the first four seconds after the chronograph has been started, to set the number 900 (for 900 kilometers per hour), and then to count down in the speed correspondingly. It is possible here to switch over to a different graduation on a toothed disk on the stop-second tube.

As an alternative to this, it is possible to provide a mechanism which only takes effect when the stopping function is triggered. A wheel train is set in motion at this point in time, said wheel train remaining at the stop second at the point at which the time is stopped. The indicator disks, rather than being moved during the actual stopping operation, are thus made to follow on.

Figure 2:
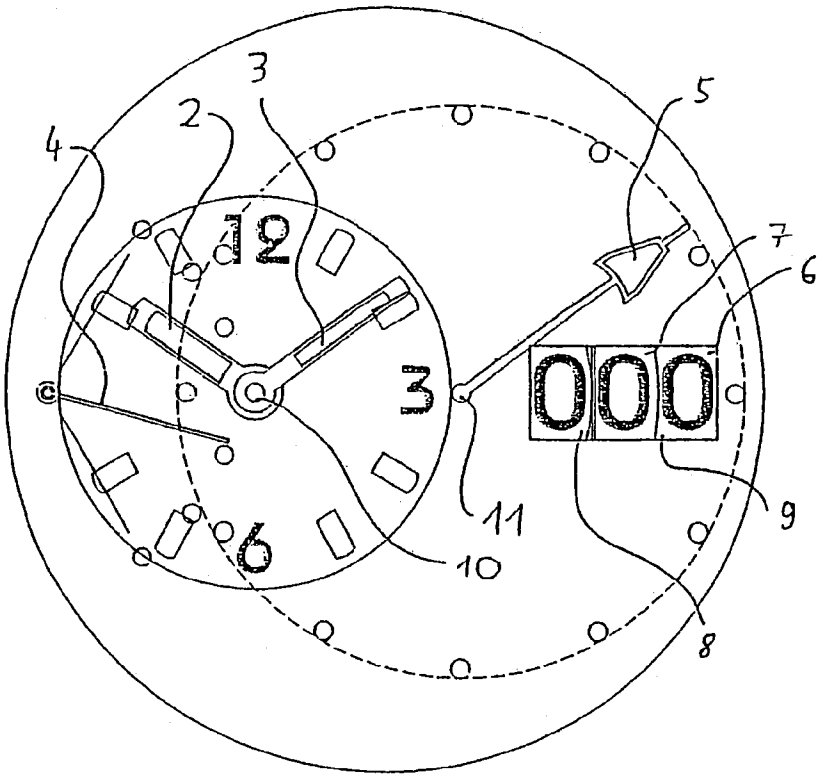
FIG. 2 shows a schematic illustration of a dial of a second exemplary embodiment of a chronograph according to the invention.

FIG. 2 shows a second exemplary embodiment of the invention, in the case of which immportance has been placed on the hour and minute hands 2 and 3 of the timepiece not covering over the chronograph display. The same features here are provided with the same designations in each case. This means, for example, that the axis 10 of the hour hand 2 and of the minute hand 3 of the timepiece is arranged at the left-hand inner periphery within the inner circle of the hour indicator (hour disk) 8 of the chronograph. The retrogressive second indicator 4 of the timepiece, by contrast, is arranged outside the minute-units disk 6. The second hand 5 of the chronograph, then, is arranged on a separate axis 11, which is located at the right-hand inner periphery within the hour indicator (hour disk) 8 of the chronograph. The axes 10 and 11 are thus arranged on mutually opposite sides within the hour disk 8. For example, the axis 11 simultaneously forms the main axis of the clockwork mechanism.

This configuration ensures that it is exclusively the second hand 5 of the chronograph which passes over the numerals of the hour and minute indicators of the chronograph, and the reading capability of this hour and minute is thus not adversely affected to any significant extent thereby.

It is, of course, also possible for the two hands 2 and 3 to be formed merely from a thin strand of material, e.g. carbon fiber, which, in order to display in the darkness, has been impregnated with a matrix of epoxy resin and a fluorescent-material mixture. Only small regions of the numbers are covered in the case of such thin hands 2 and 3 for hours and minutes, with the result that the number can still easily be read directly.

In the case of both exemplary embodiments, it is possible to provide a device for displaying the digital numerals in the dark. One possibility is for disk material located beneath the window or windows 9 to be coated with a fluorescent material. The numerals then stand out, for example, against this background. It is also possible for a ring of fluorescent material to be positioned around the surround of the window 9, so that light therefrom falls onto the window surface. If the numerals are then made essentially of a highly reflective material, they light up against the dark background of the disks. Of course, it is also possible to provide a (storage) battery-assisted luminous display.

The invention claimed is:

1. An analogue chronograph comprising a digital display, wherein the digital display displays hours and/or minutes by numbers arranged on individual circular tracks and, under a viewing window, configure an hour indicator and/or a minute indicator in digital form, wherein an inverse gearwheel transmission is provided between a clockwork mechanism and the digital display, thus resulting in a reciprocal display of numbers reciprocal in relation to a time.

2. The chronograph as claimed in claim 1, wherein the reciprocal display is a speed indicator, where once a predetermined time has elapsed the number 3600/time is displayed in rounded form.

3. The chronograph as claimed in claim 1, wherein the digital display is switchable between a time display and the reciprocal display of a speed.

4. The chronograph as claimed in claim 1, wherein the predetermined time is 4 seconds.

5. The chronograph as claimed in claim 1, wherein tens digits of the minute indicator are arranged separately from units digits of the minute indicator, on two different tracks.

6. An analogue chronograph comprising a digital display, wherein the digital display displays hours and/or minutes by numbers arranged on individual circular tracks and, under a viewing window, configure an hour indicator and/or a minute indicator in digital form, wherein an axis of the hour indicator and of the minute indicator is arranged within an inner periphery of the hour indicator, and an axis of a second indicator is arranged within the inner periphery of the hour indicator, on a side of the inner periphery of the hour indicator, the side being located opposite the axis of the hour indicator, where only a second hand of the chronograph passes over the digital display.

7. The chronograph as claimed in claim 6, wherein tens digits of the minute indicator are arranged separately from units digits of the minute indicator, on two different tracks.

8. An analogue chronograph comprising a digital display, wherein the digital display displays hours and/or minutes by numbers arranged on individual circular tracks and, under a viewing window, configure an hour indicator and/or a minute indicator in digital form, wherein the numbers include 0 to 9, the hour indicator bears a symbol provided between 9 and 0 and, once 9 hours 59 minutes and 59 seconds have elapsed, the symbol appears permanently in the hour indicator, in order to indicate that a regular measuring range has elapsed.

9. The chronograph as claimed in claim 8, wherein the symbol is a symbol commonly used in aviation for indicating that something is out of order.

10. The chronograph as claimed in claim 9, wherein the symbol is a flag.

11. The chronograph as claimed in claim 8, wherein tens digits of the minute indicator are arranged separately from units digits of the minute indicator, on two different tracks.

* * * * *